US005775299A

United States Patent [19]

Ito et al.

[11] Patent Number: 5,775,299

[45] Date of Patent: Jul. 7, 1998

[54] MULTIPLE CYLINDER ENGINE CONTROL

[75] Inventors: Takeshi Ito; Jun Taue; Kosei Maebashi, all of Iwata, Japan

[73] Assignee: Yamaha Hatsudoki Kabushiki Kaisha, Iwata, Japan

[21] Appl. No.: 782,617

[22] Filed: Jan. 13, 1997

[30] Foreign Application Priority Data

Jan. 12, 1996 [JP] Japan ..... 8-021732

[51] Int. Cl.[6] ..... F02D 41/04

[52] U.S. Cl. ..... 123/436; 73/118.2; 123/419

[58] Field of Search ..... 123/192.2, 419, 123/436, 494; 73/118.2

[56] References Cited

U.S. PATENT DOCUMENTS

| | | | |
|---|---|---|---|
| 4,197,767 | 4/1980 | Leung | 123/436 X |
| 4,418,669 | 12/1983 | Johnson et al. | 123/436 |
| 4,461,257 | 7/1984 | Hosaka et al. | 123/436 X |
| 4,495,920 | 1/1985 | Matsumura et al. | 123/436 |
| 4,535,406 | 8/1985 | Johnson | 123/436 X |
| 4,936,277 | 6/1990 | Deutsch et al. | 123/436 |
| 4,951,209 | 8/1990 | Nagaishi et al. | 123/492 X |
| 5,056,487 | 10/1991 | Yamakado et al. | 123/192.2 X |
| 5,111,405 | 5/1992 | Maeda et al. | 123/436 X |
| 5,385,129 | 1/1995 | Eyberg | 123/436 |

*Primary Examiner*—Tony M. Argenbright

*Attorney, Agent, or Firm*—Knobbe, Martens, Olson & Bear LLP

[57] ABSTRACT

A control system and method for a multi-combustion chamber internal combustion engine. Balance running between the combustion chambers is achieved by varying the engine operating parameters or the parameters of a load driven by the engine. In addition, knocking can be detected and corrected by also sensing the rate of acceleration of the engine output shaft at certain crank angles.

30 Claims, 10 Drawing Sheets

MULTIPLE CYLINDER ENGINE CONTROL

BACKGROUND OF THE INVENTION

This invention relates to an engine control system and method and more particularly to an improved system and method for a multi-cylinder engine.

With multi-cylinder engines, it is important to try to maintain substantially even running conditions in all combustion chambers. If the firing and operating conditions in the combustion chambers is not the same, the combustion chambers will, through their interaction, tend to produce less performance than if each combustion chamber operates in the same manner and with the same efficiency as the others. This equality condition is desirable but extremely difficult to obtain.

Such things as the intake and exhaust manifolding for the combustion chambers must be designed in such a way so as to obtain substantially equal induction and exhaust effects for each of the combustion chambers. In addition, the cooling and operating conditions in the combustion chambers should be maintained as uniform as possible to obtain this desire result. Although the theory is basically simple, the execution of it in practice is extremely difficult.

It is, therefore, a principal object of this invention to provide an improved engine control system and method for a multi-combustion chamber engine wherein the operating conditions of each of the combustion chambers is maintained as uniform as possible.

In order to improve the performance of an engine, not only the power and driveability but also the fuel economy and exhaust emission control, a wide variety of types of control systems and methods have been employed. One of the more successful types of systems utilized is the so-called "feedback control" type of system.

These systems employ a sensor or sensors which sense the actual air/fuel ratio in the combustion chamber or chambers of the engine. One type of sensor frequently utilized for this purpose is an oxygen ($O_2$) sensor. The $O_2$ sensor is positioned in either the combustion chamber, exhaust port or exhaust system and senses the amount of residual oxygen in the burnt charge. By determining the amount of oxygen present, it is possible to measure the actual air/fuel ratio that was burned in the combustion chamber.

These systems operate by setting a target air/fuel ratio and then comparing the actual air/fuel ratio with that target ratio. Adjustments are then made in the air and/or fuel charging systems to bring the air/fuel ratio to the desired ratio. Obviously, these types of systems offer great potential.

It should be apparent that the precise location of the sensor is important in obtaining good performance. The sensor should be in a position where it will generally sense only the combustion products before they have been mixed with a fresh incoming charge. Furthermore, these sensors tend to be quite expensive and, thus, it is desirable to provide an arrangement wherein it is not necessary to utilize and position a sensor for each combustion chamber of the engine.

It is possible to provide an arrangement wherein only one sensor is employed for multiple combustion chambers. This can be done in one of two ways. In one way, the sensor is positioned so as to read an average output from all combustion chambers of the engine. This has several disadvantages. First, the sensor must be positioned relatively remotely from the combustion chambers so as to sense the combustion products from all of them. This introduces the likelihood of mixing and erratic and non-representitive results.

Another type of system that minimizes the number of sensors uses a sensor positioned at the optimum position for one cylinder. The performance of other cylinders is then approximated from the readings of this one cylinder. This type of system also has some disadvantages.

Specifically, where only the performance of one cylinder is measured, it may be difficult, if not impossible, to relate the effects of that one cylinder on the performance of other cylinders. That is and as noted above, even if the engine is designed in such a way to obtain substantial uniformity in the intake and exhaust systems for the individual cylinders, it is difficult to obtain equal results for all cylinders. That is, the configuration of the intake and exhaust systems, which generally employ common portions, make it difficult to ensure that all cylinders are served equally.

Furthermore, the variations from cylinder-to-cylinder will vary under a wide variety of running conditions. In fact, the performance of one cylinder can even effect the charging and exhaust of another cylinder.

It is, therefore, a further object of this invention to provide an improved method and system for controlling a multi combustion chamber engine utilizing a feedback control system.

It is a further object of this invention to provide an improved method and system for operating an engine of multiple cylinders and wherein only a single sensor need be employed for controlling multiple cylinders.

In controlling the air fuel ratio for an engine, a various variety of types of sensors are employed for sensing the air flow to the engine. The types of sensors which have been employed for actually measuring air flow all provide good measurement under at least some running conditions. However, some sensors are much more accurate under only limited ranges of running conditions. Thus, unless multiple sensors are employed, the sensor chosen will not provide the accuracy under all running conditions to give good control.

Therefore, another object of this invention is to measure an engine running parameter that will give an accurate indication of air flow to the engine under widely varying conditions.

There are times when an engine is running and instability occurs in the combustion process. One factor that causes instability in the combustion process is a condition known as knocking, which is generally a phenomena associated with pre-ignition. Knocking is caused by irregular combustion in the combustion chamber. Various devices have been provided so as to control or limit knocking because it also adversely affects engine performance. However, the types of knocking controls normally employed are not effective until an actual knocking condition is sensed. When the knocking condition is sensed, then a correction is made so that subsequent combustion cycles will not experience knocking.

It is, therefore, a still further object of this invention to provide an improved system wherein the engine control is effective to anticipate when a knocking condition is likely to occur and to adjust the engine so as to prevent the actual occurrence of the knocking condition.

Heretofore, engine controls have been based primarily on controlling the actual systems of the engine. That is, these controls operate to control the induction system, the fuel charging system, the exhaust system and/or the ignition system to obtain the desired engine performance. These types of adjustments are at times complicated and the adjustment methods may become expensive.

It is, therefore, a still further object of this invention to provide an improved engine control method wherein rather than controlling the engine operating systems, other systems operated by the engine are controlled to maintain the desired results.

SUMMARY OF THE INVENTION

This invention is adapted to be embodied in a control system and method for internal combustion engine that has a plurality of variable volume chambers in which combustion occurs. An air/fuel charging system is supplied for supplying an air/fuel charge to the chambers. An ignition system is provided for initiating combustion in each chamber. An exhaust system is also provided for discharging the exhaust gases from the chambers to the atmosphere. An engine output shaft is driven by the combustion which occurs in the chambers. An engine shaft speed sensor is provided for sensing the instantaneous engine output shaft speed at at least one shaft angle during a cycle phase for each chamber. A load system is driven by the engine output shaft. A control is provided for controlling at least one of the systems to maintain the desired operating condition relationship between the chambers.

DETAILED DESCRIPTION OF THE PREFERRED EMBODIMENTS OF THE INVENTION

Figure 1:
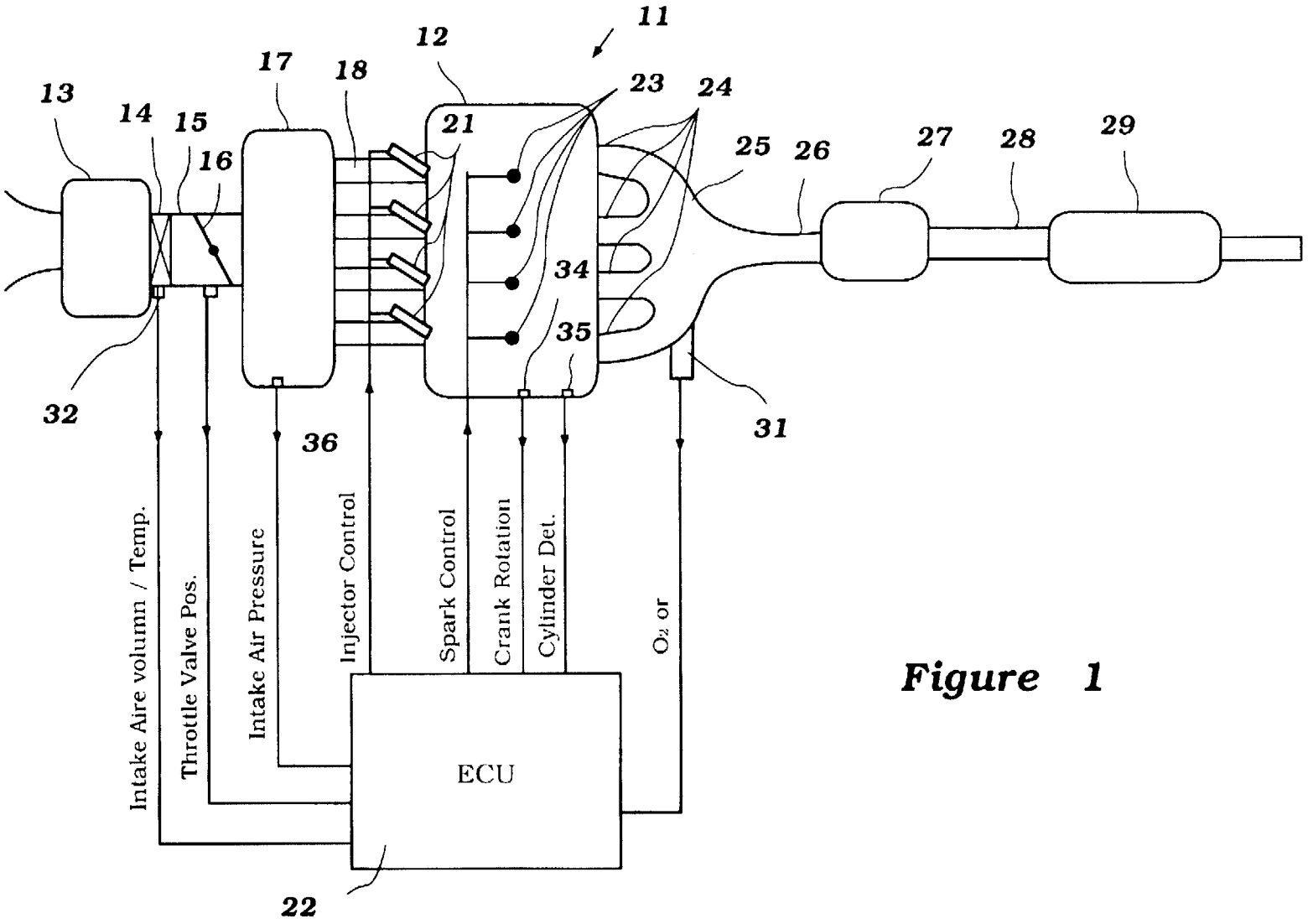
FIG. 1 is a top plan and partially schematic view of an internal combustion engine having a control system and methodology constructed in accordance with an embodiment of the invention.

Referring now in detail to the drawings and initially to FIG. 1, an internal combustion engine and control system constructed and operated in accordance with an embodiment of the invention is indicated generally by the reference numeral 11. Since the invention deals primarily with the control system and methodology and not with specific details of the construction of the engine 11, it is illustrated generally schematically.

In the illustrated embodiment, the engine 11 is comprised of a cylinder block/cylinder head assembly 12 that forms four in-line cylinder bores. Obviously, those skilled in the art will readily understand from the following description how the invention can be utilized with engines having other cylinder numbers and other cylinder configurations. The invention, however, has particular utility in conjunction with multiple cylinder engines. Although the invention is described in conjunction with a reciprocating engine, it may also be practiced with multiple combustion chamber engines of the rotary type.

The cylinder bores of the cylinder block/cylinder head assembly 12 reciprocally support pistons that are connected by means of connecting rods to drive an engine crankshaft or output shaft in well-known manner.

The engine 11 is provided with an induction system which includes an air inlet device 13 in which an air filter 14 is mounted. The inlet device serves a throttle body 15 in which a manually operated throttle valve 16 is positioned.

The throttle body 15 communicates with a plenum chamber or surge tank 17 from which a plurality of intake manifold runners 18 extend. These intake manifold runners 18 each serve intake ports formed in the cylinder block/cylinder head assembly 12 for delivering the intake charge to the engine combustion chambers. The engine may be provided with one or multiple intake valves per cylinder. Preferably, the intake valves are operated by an overhead camshaft that is driven at one-half crankshaft speed by a suitable timing drive.

The air charging system is augmented by a fuel charging system which, in the illustrated embodiment, comprises a plurality of manifold-type fuel injectors 21 which inject fuel into either the manifold runners 18 or the intake ports of the cylinder block/cylinder head assembly 12. As should be readily apparent, the invention may also be practiced with direct injected engines. Certain facets of the invention may also be practiced with carbureted engines.

The timing and duration of fuel injection is controlled by an ECU shown schematically at 22 and which operates in accordance with a control strategy which will be described. Basically, this control strategy permits the timing and duration of injection from each of the injectors 21 to be controlled independently of the others. This is done, as will become apparent, to maintain the desired air/fuel ratio and desired cylinder to cylinder running characteristics.

Spark plugs 23 are mounted in the cylinder head portion of the cylinder block/cylinder head assembly 12 and are fired by a suitable ignition system. Like the fuel injection of the fuel injectors 21, the timing of firing of each of the spark plugs 23 is independently controlled by the ECU 22.

The charge which has been ignited in the combustion chambers by the spark plugs 23 will bum and expand and drive the pistons in the cylinder bores downwardly so as to drive the crankshaft of the engine in a known manner. The burnt charge is discharged through an exhaust system which includes exhaust ports formed in the engine for the individual cylinder bores and the flow through which is controlled by exhaust valves. The engine 11 may be provided with either one or more exhaust ports and exhaust valves per cylinder. Like the intake valves, the exhaust valves are operated by an overhead mounted camshaft in a know manner.

The exhaust ports in the cylinder block/cylinder head assembly 12 communicate with exhaust manifold runner sections 24 which, in turn, communicate with a collector section 25. The collector section 25 has an outlet 26 that communicates with a catalytic converter 27. A three-way catalyst is provided in this catalytic converter 27 for treating the exhaust gases. From the catalytic converter 27, the exhaust gases delivered through a connector pipe 28 to a muffler or other silencing device 29 and then to the atmosphere.

As has been noted, the construction of the engine 11 has been described only generally and those skilled in the art will readily understand how to apply the invention in conjunction with any of a wide variety of types of engines. For this reason, further details of the construction of the engine 11, except for its control strategy and the sensors associated with it, are not believed to be necessary to permit those skilled in the art to practice the invention.

Basically, the ECU 22 operates on a feedback control system that includes an oxygen or air/fuel ratio sensor, shown schematically at 31 and which is placed in one of the exhaust manifold collector section 25. In the illustrated embodiment, the sensor 31 is placed in the collector section 25 adjacent the runner 24 associated with the number 1 cylinder, numbering the cylinders from bottom to top as seen in FIG. 1.

In addition to the output of the sensor 31 to the ECU 22, additional sensors are provided for engine control. These may include an intake air volume or temperature sensor 32 positioned adjacent the air filter 14. A throttle position or load sensor 33 is associated with the throttle body 15 and provides a signal indicative of the position of the throttle valve 16.

Also, a crank angle sensor 34 is associated with the engine crankshaft and outputs a signal that is indicative of the angle of the crankshaft and, by comparison of the angle with time, the speed of the rotation of the crankshaft. This speed signal is utilized to provide not only an average speed signal, but also an instantaneous speed signal and the change of speed of rotation of the crankshaft. This will be described later.

In addition, there is provided a cylinder detector 35 which indicates which of the cylinders is at top dead center position or when a specific one of the cylinders is at that position.

The intake air pressure in the plenum chamber 17 is sensed by a sensor 36 and this information is also transmitted to the ECU 22.

Regardless of the attempts to design the engine so that there is equality between the cylinders, intake air volume varies from cylinder to cylinder in a nonlinear fashion. Thus, an arrangement is provided for making an adjustment for the variation in intake air volume from cylinder to cylinder so that, when the fuel amount is changed, the actual fuel ratio can be more accurately controlled in response to the actual rather than assumed air flow to each cylinder.

In accordance with the invention, it is possible to determine the actual intake air volume by measuring the change in speed of the crankshaft between two crank angles, between one crank angle and an average or instantaneous crankshaft acceleration. Then the intake air volume for each cylinder can be derived from this instantaneous acceleration or change in velocity.

Figure 2:
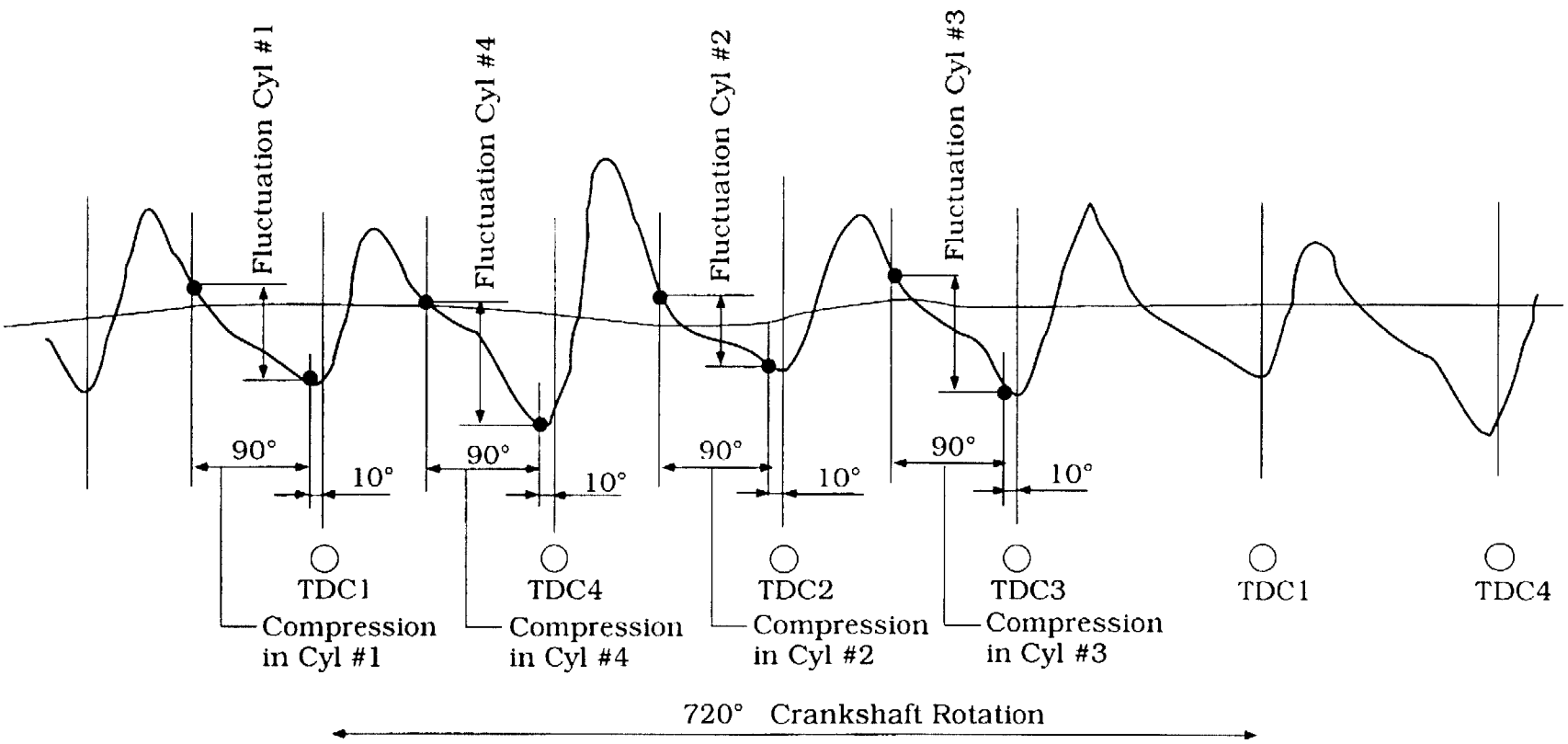
FIG. 2 is a graphical view showing how the engine speed varies from cylinder-to-cylinder and during a single revolution, and also depicts the measurement period utilized in accordance with the invention.

As may be seen in FIG. 2, the instantaneous rotational speed of the crankshaft varies during a single rotation of the crankshaft or during several rotations. Thus the crankshaft is constantly accelerating or decelerating. FIG. 2 shows the rotation through 720° or two complete rotations.

Figure 3:
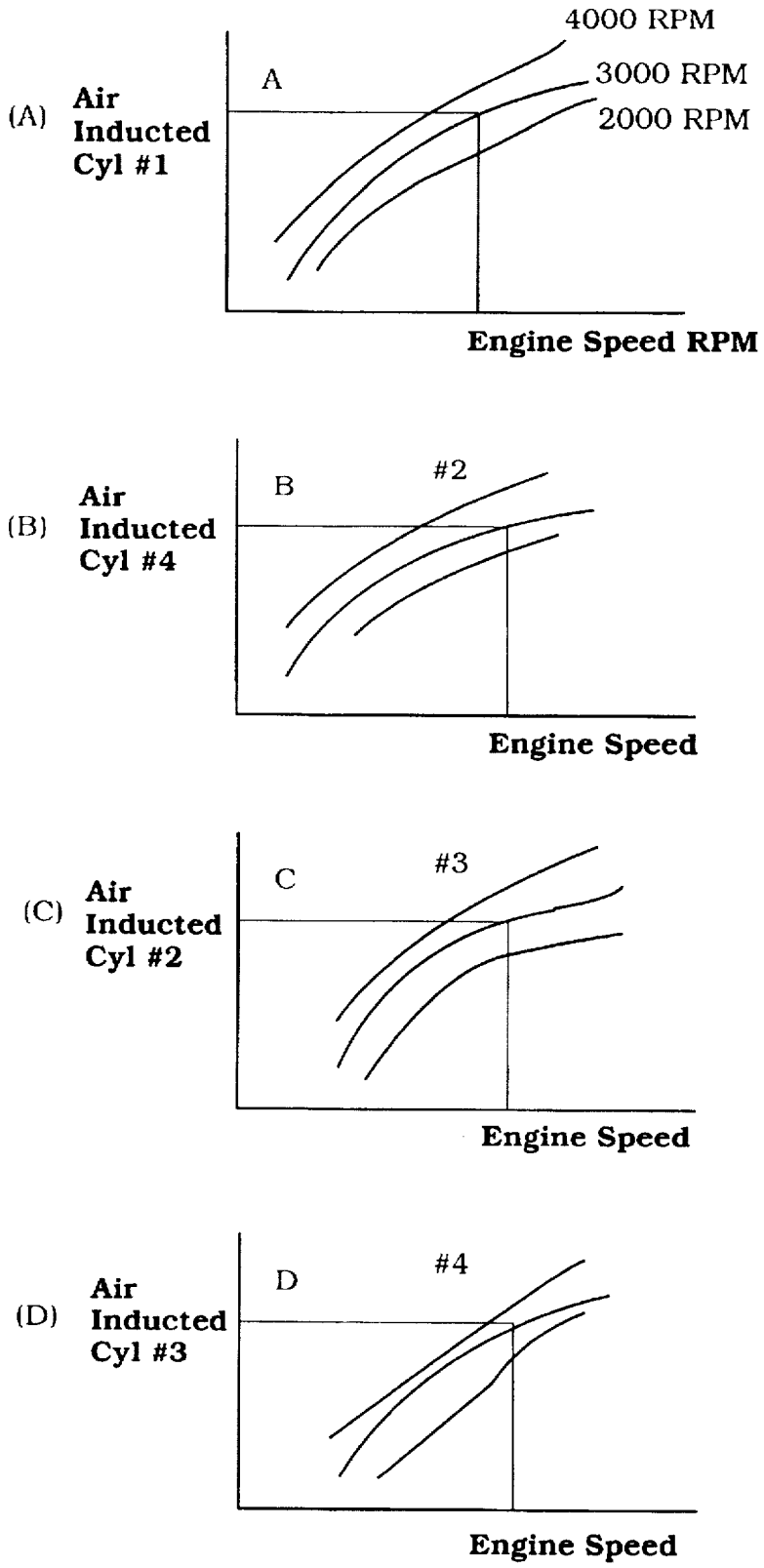
FIG. 3 is a series of graphical views showing the variation in instantaneous crank angle speed associated with each cylinder at varying engine speeds and shows how the intake air volume varies in accordance with such speed variations.
Figure 4:
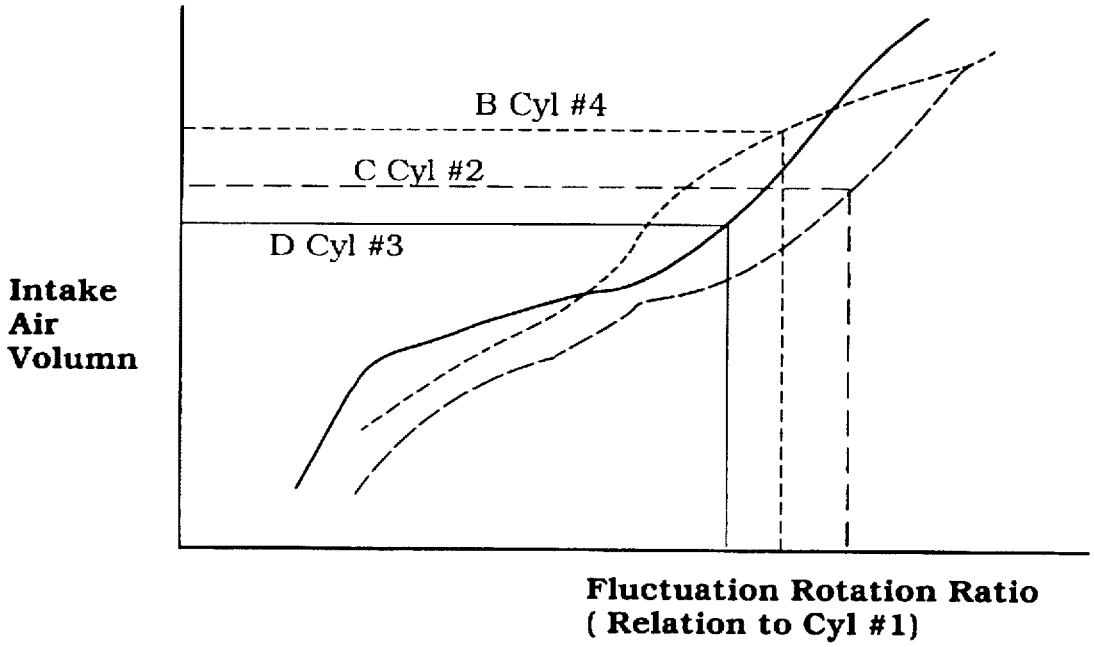
FIG. 4 is a graphical view, in part, similar to those of FIG. 3 and shows the variation of cylinder-to-cylinder from a specific cylinder under the same conditions.

As may be seen in FIG. 3, at different engine speeds there is a difference in intake air volume between the cylinders for a given engine speed during a given cycle. Also, it will be seen that the curves for each cylinder are different. Therefore, a ratio map is established as shown in FIG. 4 which can be utilized to determine corrective factors in speed ratio so as to determine the actual air that has been inducted in the cylinder. Then the fuel amount delivered to the respective cylinder can be varied in order to provide the feedback control amount required in order to balance the cylinders and provide the desired air/fuel ratio in each cylinder.

As may be seen from FIG. 2, the speed of rotation of the crankshaft varies during a given revolution. When a specific cylinder has fired, the crankshaft speed will increase at the time that the charge begins to burn and expand and this occurs at approximately 10 degrees before top dead center for the specific firing cylinder. This velocity then increases while the piston moves downwardly until the effect of the next firing cylinder and the compression in it will cause a reduction in the velocity. By measuring the actual crankshaft velocity and/or acceleration at a time during the compression process for a given cylinder, which can be assumed to take place during the time period of about 90 degrees of crankshaft rotation before the 10 degrees before top dead center position, it is possible to determine the actual air amount that has been inducted into each cylinder.

This is done by using maps such as those shown in FIG. 3 and/or the corrective factors as shown in FIG. 4. Thus, by measuring the instantaneous crank rotational speed at a particular point during the compression cycle or measuring the speed at two spaced crank angles, the former being preferred, it is possible to determine the intake air volume. The cylinder firing order depicted is 1-4-2-3, but it should be understood that similar curves would apply for other firing orders.

Figure 5:
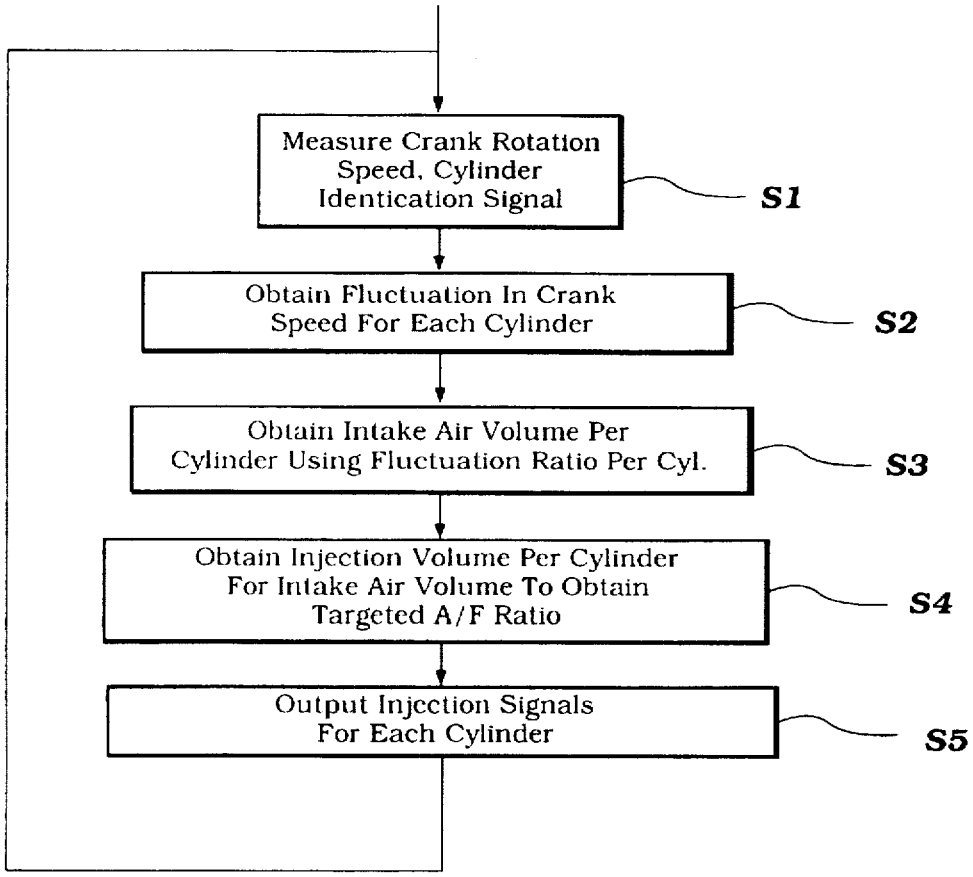
FIG. 5 is a block diagram showing the control routine in accordance with a feature of the invention.

Referring now to FIG. 5, the control routine for this facet of the invention is illustrated and will be described. In this routine at the step S1, the ECU 22 registers the instantaneous crank rotational speed by utilizing the crank rotation sensor 34 and internal timer to measure the instantaneous speed and, also, to determine from the cylinder discriminating sensor 35 which cylinder is approaching top dead center condition.

The program then moves to step S2 to obtain the fluctuation in crank rotational speed at the two 90 degree positions for each cylinder as shown in FIG. 2 or in relation to an average measures crank speed so as to obtain the speed fluctuation during the compression cycle for each cylinder.

Having obtained this data, then the program moves to step S3 to read the intake air volume per cylinder based upon the fluctuation in crankshaft speed for that cylinder. This is done on a ratio determination utilizing the map of FIG. 4.

Having this data, the program then moves to step S4 wherein the amount of fuel injected per cylinder can be determined by selecting the amount of fuel required per cylinder in relation to the amount of air inducted to obtain the target air fuel ratio. The program then moves to step S5 where the ECU 22 outputs the injection signals to the fuel injectors 21. These signals are an injection beginning timing signal and a duration signal so as to provide the injection timing and duration to obtain the fuel air ratio targeted.

Figure 6:
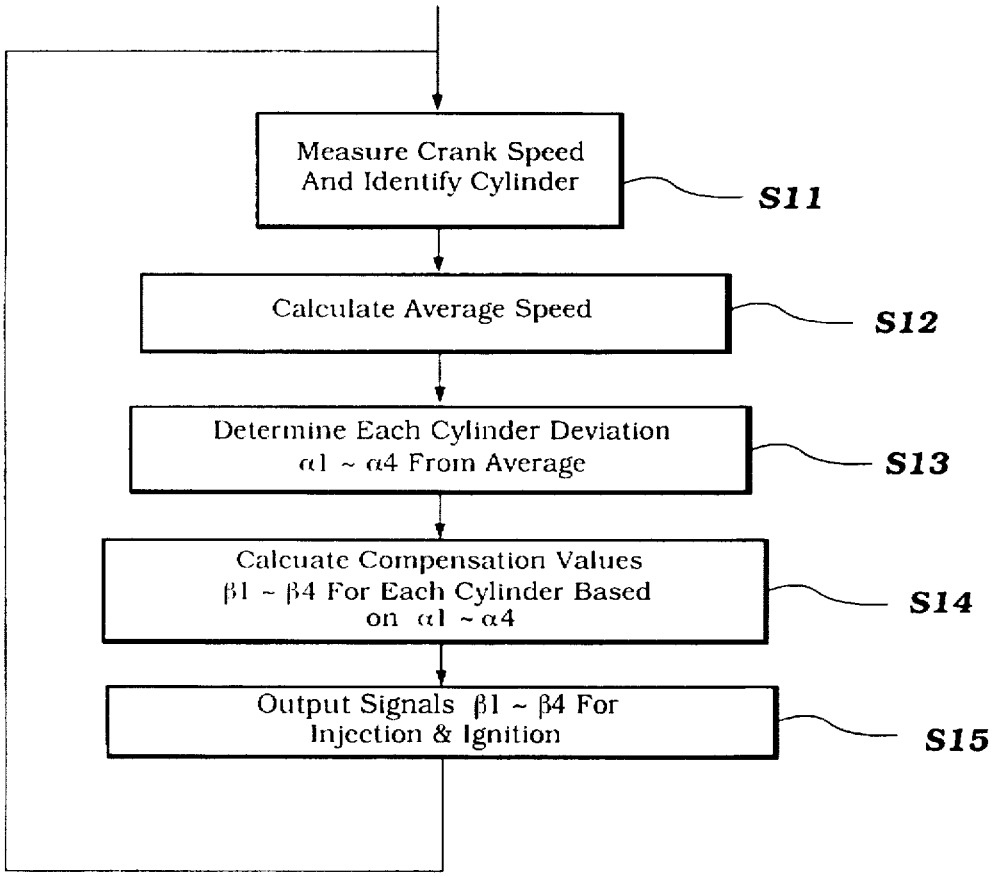
FIG. 6 is another block diagram of a control routine for controlling the timing of fuel injection and ignition to maintain the desired relationship of crankshaft speed acceleration.

A further and more specific control routine for setting the timing of beginning of injection and ignition is illustrated in FIG. 6 and will be described by reference to that figure. The program begins at the step S11 and again measures the crankshaft rotational speed and determines the signal indication as to the cylinder for which the speed is being measured.

The program then moves to the step S12 so as to calculate an average crankshaft rotational speed to form the basis to determine the variations between the individual cylinders. This is done by either measuring a large degree of crankshaft rotation such as 360° and then dividing it by time or by averaging instantaneous readings throughout one or more revolutions.

The program then moves to the step S13 so as to determine the speed variations $\alpha_1$~$\alpha_4$ for each cylinder at a specific crank angle in comparison with the average speed. The program then moves to a lookup map in the step S14 so as to calculate from the crank angle velocity variations $\alpha_1$~$\alpha_4$ the compensation values $\beta_1$~$\beta_4$ for each cylinder for its injection and ignition timings so as to try to maintain a more equal speed or a change in speed for each cylinder.

The program then moves to the step S15 so as to output the injection and ignition timing signals for discharging fuel for each cylinder and for firing the spark plugs at the appropriate timing in order to stabilize the engine speed throughout the rotations of the crankshaft by minimizing cylinder-to-cylinder speed variation.

Figure 7:
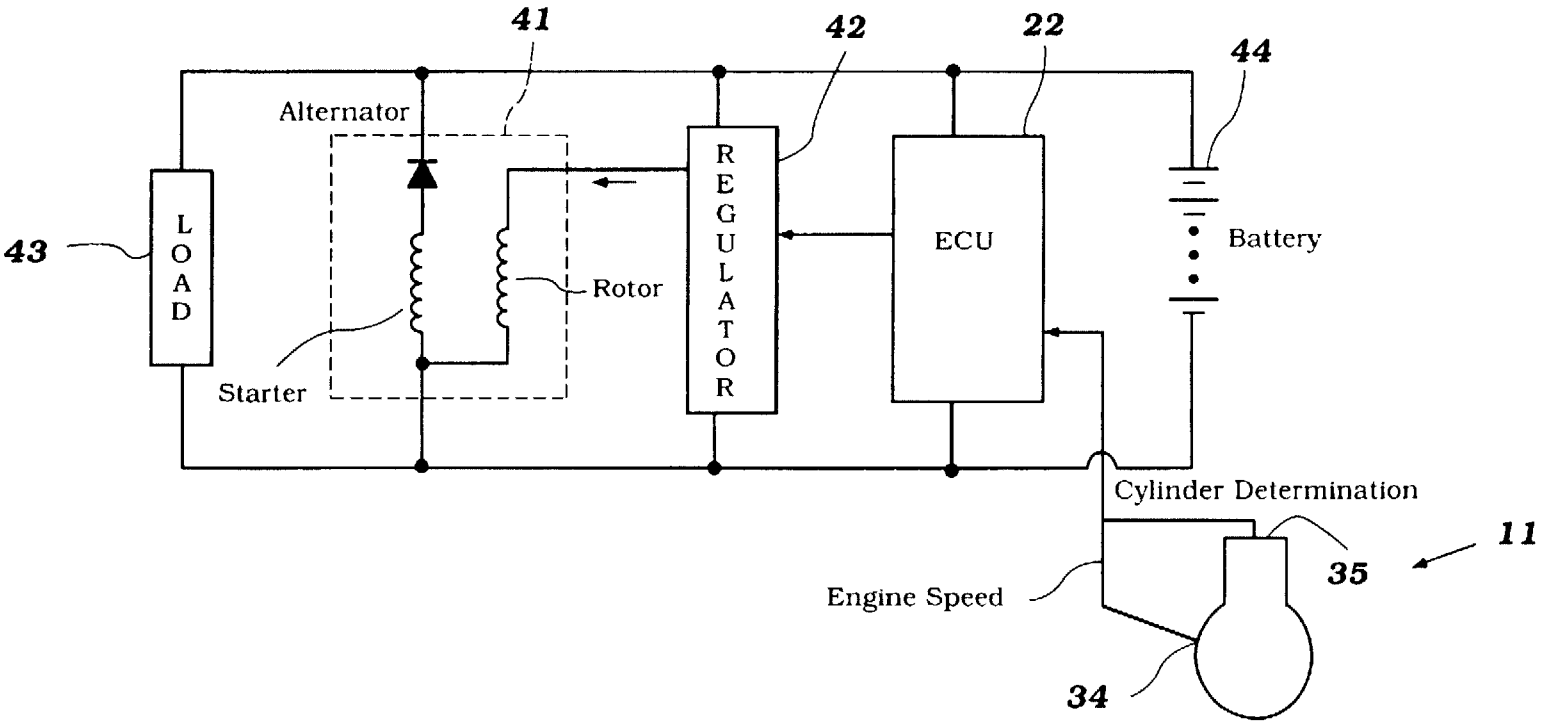
FIG. 7 is a partially schematic electrical diagram showing how the engine load may be adjusted so as to maintain the desired cylinder running conditions in accordance with another feature of the invention.

In addition to maintaining more uniform speed through the rotation of the crankshaft as each cylinder fires by controlling the fuel injection amount and timing and spark timing, the speed can be stabilized also by varying external loads on the engine. For example, if the engine 11 drives a load such as an electrical generator, and a load may be imposed upon this generator that will cause the engine speed to reduce or increase by increasing or decreasing the generator load. Such an embodiment is illustrated in FIG. 7 and its operation can be understood by reference to FIG. 8.

As seen in this Figure, the engine 11 drives an alternator, shown schematically at 41 which is controlled through the ECU 22 by a regulator 42 and which, in turn, drives one or more electrical loads 43 and also can charge a battery 44. The ECU 22, like the previous described embodiments receives signals from the engine 11 and specifically from the cylinder discriminator 35 and crank rotation speed sensor 34. These signals are shown in the upper view of FIG. 8 which illustrates the speed variations per cylinder at $\alpha_1$, $\alpha_2$,$\alpha_3$ and $\alpha_4$ in relation to the average speed curve.

Figure 8:
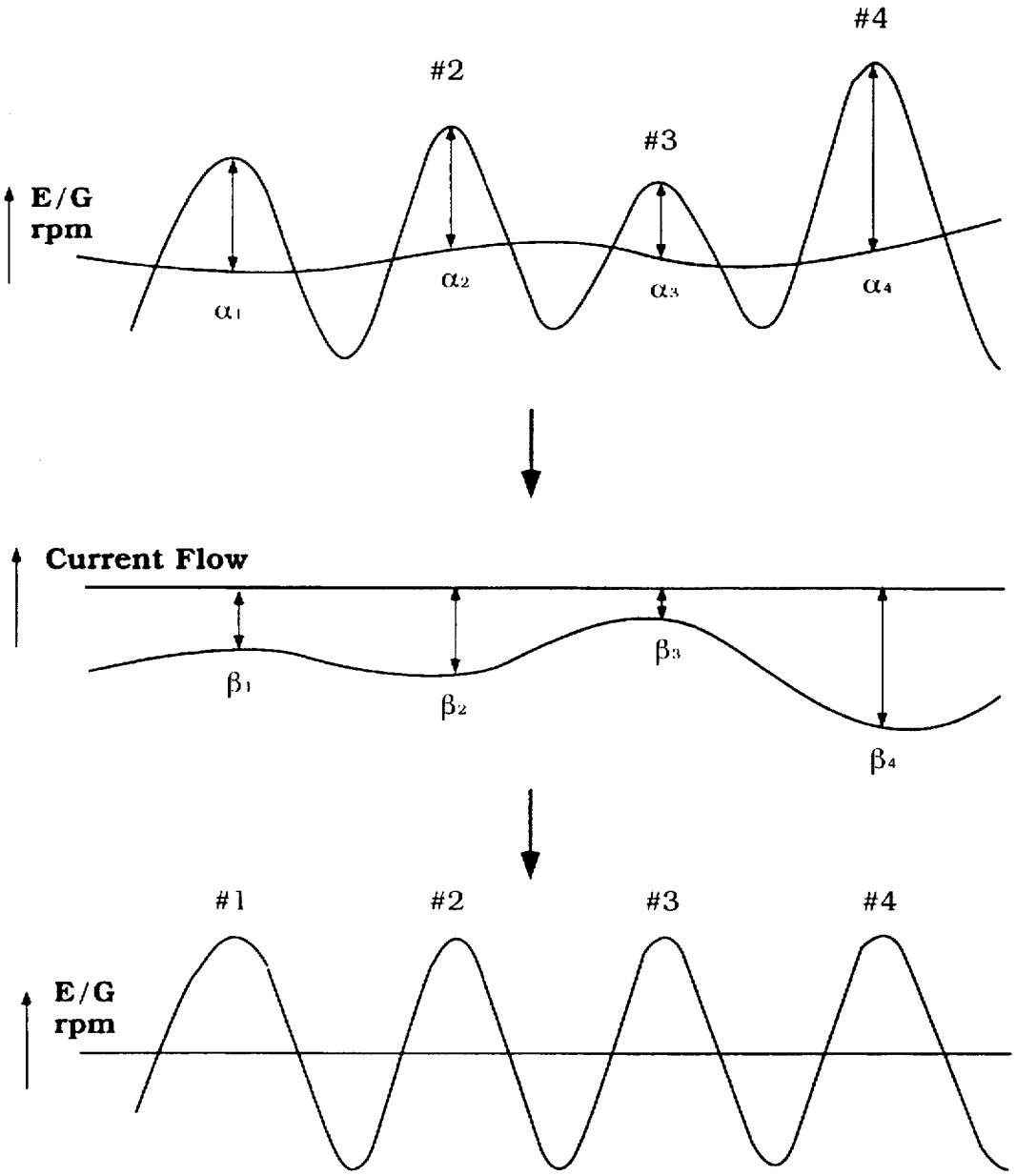
FIG. 8 is a graphical view showing how the electrical load and engine speed is varied to practice this feature of the invention.

This data is then processed by the ECU in the manners previously described to provide corrective load values $\beta_1$, $\beta_2$, $\beta_3$ and $\beta_4$ which are impressed through the regulator 42 on the windings of the alternator 41 as shown in the center view of FIG. 8 to provide a varying load on the alternator which, obviously, influences the engine speed. As a result, the engine speed can be maintained more uniform between cylinders as seen in the lower curve of FIG. 8. In this way, the engine speed can be maintained more uniform from cylinder-to-cylinder by utilizing an external load rather than controlling the running of the engine directly. Also, these methods can be used in combination with each other. That is, both the spark timing, fuel injection timing and amount, and external load may be all controlled to maintain uniform speed variations between the cylinders.

In accordance with another feature of the invention, it is possible from the crankshaft rotational speed or acceleration to predict when knocking is occurring and take corrective action to preclude such knocking. This concept and method may be understood by reference to FIG. 9.

Figure 9:
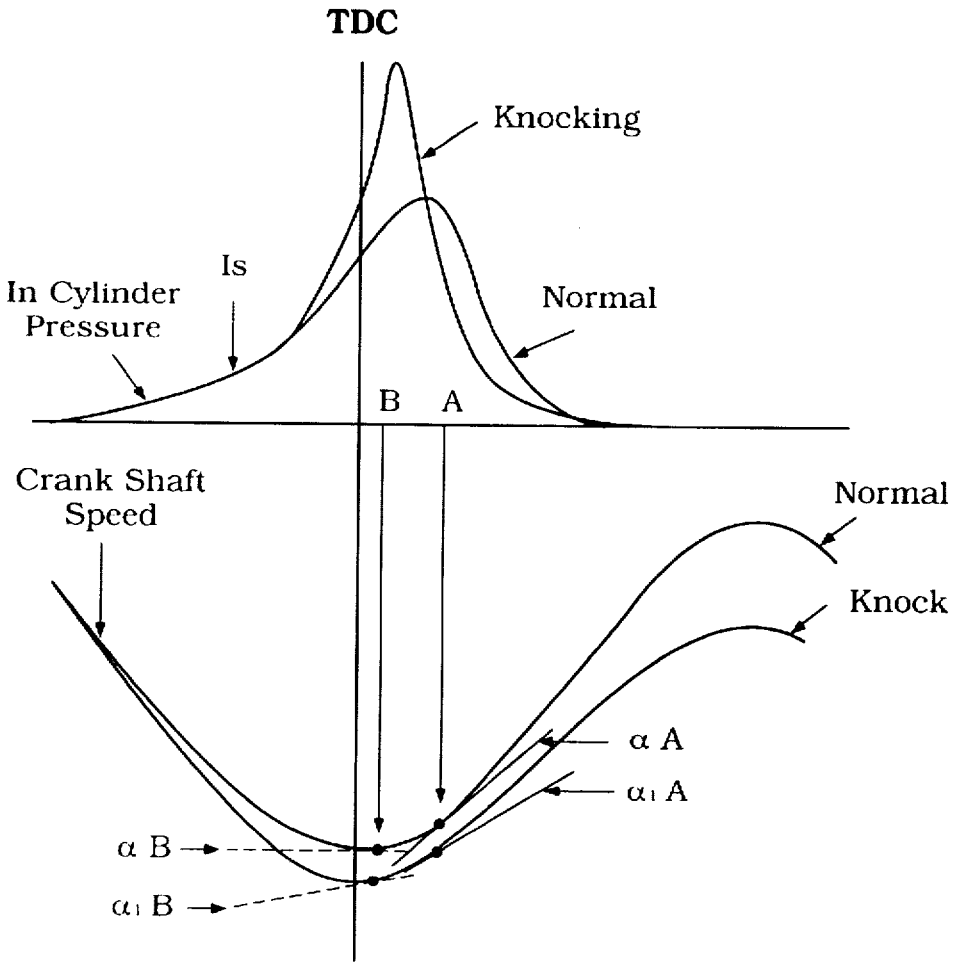
FIG. 9 is a graphical view showing in cylinder pressure for normal running and knocking conditions and crankshaft speed acceleration in response to these same two running conditions.

In the upper portion of FIG. 9, there are two pressure curves shown. These are in cylinder pressure curves taken at a point beginning during the compression cycle, showing ignition timing and how the pressure builds up in the cylinder when normal combustion occurs and when knocking occurs. When knocking occurs, the pressure peaks in the cylinder at a much higher value and earlier after top dead center than with normal combustion. This higher and earlier peak of pressure has the effect of changing the crankshaft speed as shown in the lower curve.

As may be seen, the fact that the pressure builds up more rapidly and earlier in the cycle and particularly before top dead center when a knocking condition prevails, the crankshaft speed falls lower than under the normal running. Also, immediately after top dead center at a point before peak pressure, indicated by the reference line B the more rapid buildup in pressure with the knocking condition causes the acceleration of the crankshaft to be higher at this point. However, the acceleration at a point after the peak normal pressure buildup indicated at the point A is lower since the speed dissipates more rapidly due to the rapid fall-off in pressure in the cylinder after top dead center. These acceleration lines are shown as $\alpha_1$B and $\alpha$B and $\alpha_1$A and $\alpha$A in FIG. 9.

Thus, by sensing the crankshaft acceleration at either the points A or B, it is possible to tell if a knocking condition is occurring or is likely to occur. Then collective actions can be taken.

For example, when reading at the point B, if the acceleration curve is positive then it can be assumed that a knocking condition is going to occur or is occurring. On the other hand, if the acceleration at the point A is less than $\alpha$A then it can be assumed that a knocking condition is prevailing and corrective action can be taken.

Figure 10:
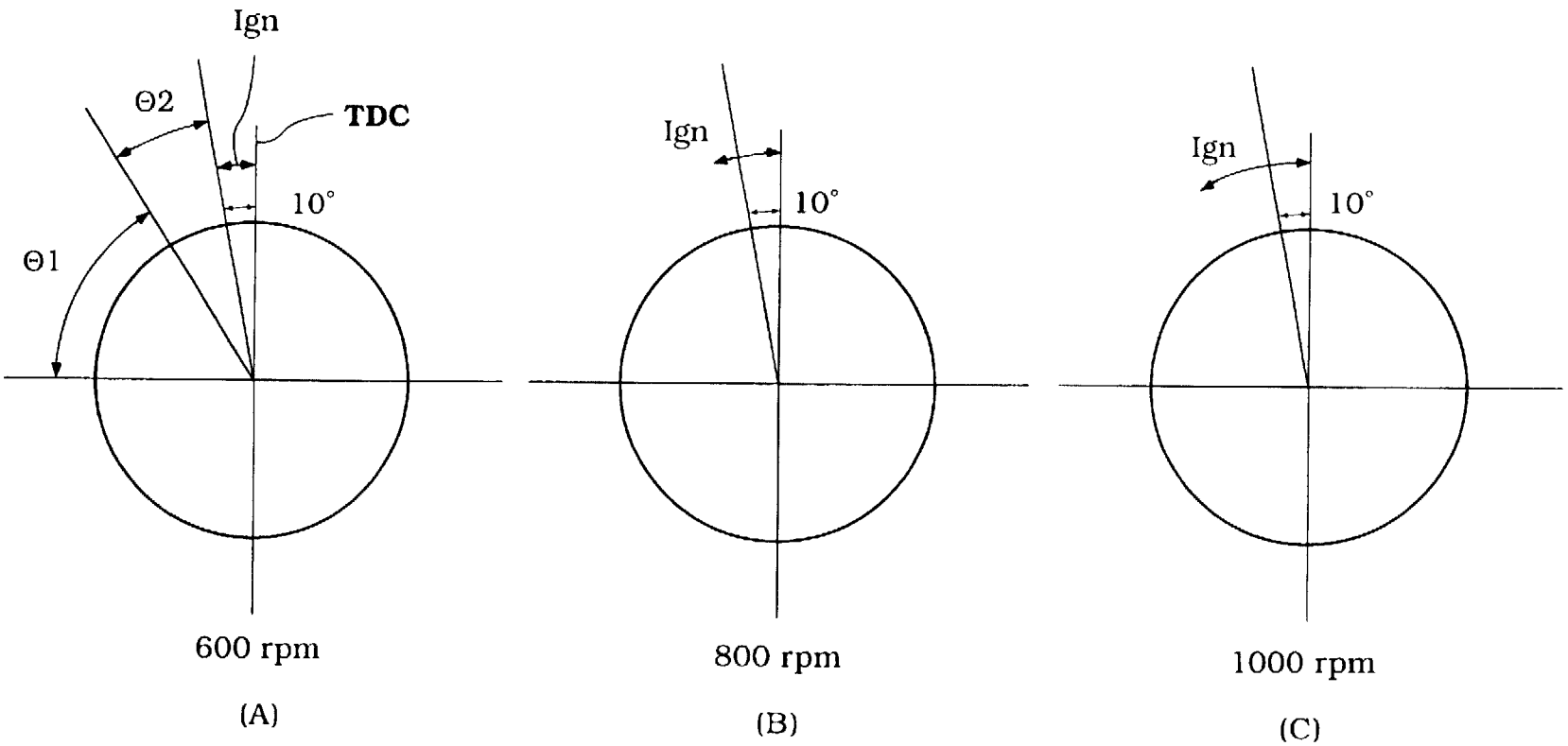
FIG. 10 is a graphical view showing the timing diagram of ignition at certain speeds in the low and idle speed range and also showing the measurement ranges in accordance with a feature of the invention.

FIG. 10 shows the conditions at low engine speed such as at idle 600 rpm or slightly off idle. At idle, the spark advance for normal running is approximately 10 degrees before top dead center and this spark advance generally is increased as the engine speed increases as shown by the curves B and C. As has been noted, it is important to read the engine crankshaft speed at a time preferably prior to ignition and at idle or low speeds preferably before the range $\theta 2$ to such as the range $\theta 1$ in the Figure A portion of FIG. 10. This will permit good measurement and accurate control at idle.

Of course, the foregoing description is that of preferred embodiments of the invention, and various changes and modifications may be made without departing from the spirit and scope of the invention, as defined by the appended claims.

What is claimed is:

1. A control system for an internal combustion engine comprising a plurality of variable volume combustion chambers, an air/fuel charging system for delivering a fuel/air charge to said combustion chambers, an ignition system for initiating combustion in each of said combustion chambers, an exhaust system discharging a burnt charge from said combustion chambers, an output shaft driven by the combustion in said combustion chambers, a speed sensor for sensing the instantaneous engine output shaft speed at at least one shaft angle during a cycle phase for each of said combustion chambers, a load system driven by said engine output shaft, said air/fuel charging system including means for controlling the amount of fuel supplied in response to the amount of air inducted into the combustion chamber, means for calculating the amount of air inducted by measuring the speed of the engine output shaft, and a control for controlling at least one of said systems to maintain the desired operating condition relationship between said combustion chambers.

2. An internal combustion engine as set forth in claim 1, wherein the desired operating condition is uniform combustion in each of the combustion chambers.

3. An internal combustion engine as set forth in claim 2, wherein the uniform combustion is maintained by adjusting the air fuel ratio supplied by the air fuel charging system.

4. An internal combustion engine as set forth in claim 3, wherein the amount of fuel supplied by the air/fuel charging system is adjusted to maintain the uniform combustion.

5. An internal combustion engine as set forth in claim 1, wherein the engine speed is compared with another engine speed to determine the amount of air inducted.

6. An internal combustion engine as set forth in claim 5, wherein the other engine speed is a speed at another point in the rotation of the engine output shaft.

7. An internal combustion engine as set forth in claim 5, wherein the other engine speed is an average speed of the engine output shaft.

8. An internal combustion engine as set forth in claim 1, wherein the desired operating condition comprises uniformity in the speed of the engine output shaft during the firing of each of the combustion chambers.

9. An internal combustion engine as set forth in claim 8, wherein the uniform speed is maintained by adjusting the air fuel ratio supplied by the air fuel charging system.

10. An internal combustion engine as set forth in claim 9, wherein the amount of fuel supplied by the air fuel charging system is adjusted to maintain the uniform engine speed.

11. An internal combustion engine as set forth in claim 9, wherein the desired engine speed is maintained by varying the load system.

12. An internal combustion engine as set forth in claim 11, wherein the load system comprises an electrical generator driven by the engine.

13. An internal combustion engine as set forth in claim 12, wherein the output of the electrical generator is varied to maintain the uniform speed.

14. An internal combustion engine as set forth in claim 1, wherein the desired operating condition is a condition devoid of knocking.

15. An internal combustion engine as set forth in claim 14, wherein knocking is determined by comparing the acceleration of the engine output shaft with a known normal acceleration rate.

16. A control method for an internal combustion engine comprising a plurality of variable volume combustion chambers, an air/fuel charging system for delivering a fuel/air charge to said combustion chambers, an ignition system for initiating combustion in each of said combustion chambers, an exhaust system discharging a burnt charge from said combustion chambers, an output shaft driven by the combustion in said combustion chambers, and a load system driven by said engine output shaft, said method comprising the steps of sensing the instantaneous engine output shaft speed at at least one shaft angle during a cycle phase for each of said combustion chambers and controlling at least one of said systems to maintain the desired operating condition relationship between said combustion chambers, controlling the amount of fuel supplied response to the amount of air inducted into the combustion chamber, and determining the amount of air by measuring the speed of the engine output shaft.

17. A control method for an internal combustion engine as set forth in claim 16, wherein the desired operating condition is uniform combustion in each of the combustion chambers.

18. A control method for an internal combustion engine as set forth in claim 17, wherein the uniform combustion is maintained by adjusting the air fuel ratio supplied by the air fuel charging system.

19. A control method for an internal combustion engine as set forth in claim 18, wherein the amount of fuel supplied by the air fuel charging system is adjusted.

20. A control method for an internal combustion engine as set forth in claim 16, wherein the engine speed is compared with another engine speed to determine the amount of air inducted.

21. A control method for an internal combustion engine as set forth in claim 20, wherein the other engine speed is a speed at another point in the rotation of the engine output shaft.

22. A control method for an internal combustion engine as set forth in claim 20, wherein the other engine speed is an average speed of the engine output shaft.

23. A control method for an internal combustion engine as set forth in claim 16, wherein the desired operating condition comprises uniformity in the speed of the engine output shaft during the firing of each of the combustion chambers.

24. A control method for an internal combustion engine as set forth in claim 23, wherein the uniform speed is maintained by adjusting the air fuel ratio supplied by the air fuel charging system.

25. A control method for an internal combustion engine as set forth in claim 24, wherein the amount of fuel supplied by the air fuel charging system is adjusted.

26. A control method for an internal combustion engine as set forth in claim 23, wherein the desired engine speed is maintained by varying the load system.

27. A control method for an internal combustion engine as set forth in claim 26, wherein the load system comprises an electrical generator driven by the engine.

28. A control method for an internal combustion engine as set forth in claim 27, wherein the output of the electrical generator is varied to maintain the uniform speed.

29. A control method for an internal combustion engine as set forth in claim 16, wherein the desired operating condition is a condition devoid of knocking.

30. A control method for an internal combustion engine as set forth in claim 29, wherein knocking is determined by comparing the acceleration of the engine output shaft with a known normal acceleration rate.

* * * * *